US009481108B2

(12) United States Patent
Sowa

(10) Patent No.: US 9,481,108 B2
(45) Date of Patent: Nov. 1, 2016

(54) METHOD FOR PRODUCING A QUARTZ-GLASS HOLLOW CYLINDER

(71) Applicant: Heraeus Quarzglas GmbH & Co KG

(72) Inventor: René Sowa, Pouch (DE)

(73) Assignee: Heraeus Quarzglas GmbH & Co. KG, Hanau (DE)

( * ) Notice: Subject to any disclaimer, the term of this patent is extended or adjusted under 35 U.S.C. 154(b) by 260 days.

(21) Appl. No.: 14/389,732

(22) PCT Filed: Mar. 13, 2013

(86) PCT No.: PCT/EP2013/055095

§ 371 (c)(1),
(2) Date: Sep. 30, 2014

(87) PCT Pub. No.: WO2013/143844

PCT Pub. Date: Oct. 3, 2013

(65) Prior Publication Data

US 2015/0078846 A1 Mar. 19, 2015

(30) Foreign Application Priority Data

Mar. 30, 2012 (DE) ..... 10 2012 006 410

(51) Int. Cl.
*B28D 5/02* (2006.01)
*B28D 1/14* (2006.01)

(52) U.S. Cl.
CPC ..... *B28D 5/021* (2013.01); *B28D 1/14* (2013.01); *Y10T 408/03* (2015.01)

(58) Field of Classification Search
CPC ..... B28D 5/021; B28D 1/14; Y10T 408/03; B24B 49/12; B24B 37/013; B24B 37/205; B24B 37/04; B24B 49/04; B24B 33/02; B24B 5/40; B24B 19/02; B24B 5/185; B24B 23/08
USPC ..... 451/5, 6, 41, 51, 61
See application file for complete search history.

(56) References Cited

U.S. PATENT DOCUMENTS 2,528,043 A * 10/1950 Dolmage ..... B24B 23/08 33/613
5,022,195 A * 6/1991 Cattelain ..... B23Q 3/183 451/381

(Continued)

FOREIGN PATENT DOCUMENTS

JP 2010247340 A 11/2010

OTHER PUBLICATIONS

Espacenet English language abstract of JP 2010247340 A, published Nov. 4, 2010.

*Primary Examiner* — George Nguyen
(74) *Attorney, Agent, or Firm* — Tiajoloff & Kelly LLP

(57) ABSTRACT

Previously, in order to produce a dimensionally stable fused-quartz hollow cylinder, an output cylinder having a centre axis would have been prepared, said output cylinder being produced by means of a bore having a boring bar, said bore rotating about a horizontal axis of rotation, and by means of a boring head that has an internal bore and is fixed to said bore in a torsionally rigid manner, wherein the boring head adopts a continually changing boring head position that is continuously ascertained by means of a measuring device and is returned to a target position in the event of any deviation. The design outlay is high, however. The problem addressed by the invention is therefore that of providing a cost-effective method for producing a dimensionally stable fused-quartz hollow cylinder.

10 Claims, 1 Drawing Sheet

(56) References Cited

Figure 1:
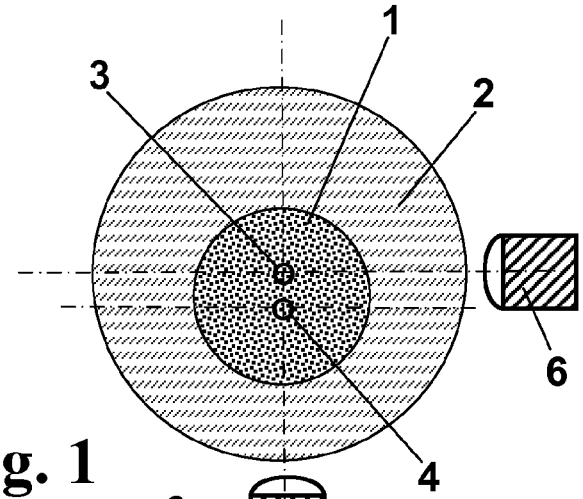

U.S. PATENT DOCUMENTS 5,177,904 A * 1/1993 Nagel ..... B24B 33/06 451/156
5,690,541 A * 11/1997 Dalke ..... B24B 15/02 451/359
5,934,976 A * 8/1999 Makino ..... B24B 1/04 451/115
6,616,508 B1 * 9/2003 Kamamura ..... B24B 5/10 451/21
6,846,226 B2 * 1/2005 Kapgan ..... B23B 51/101 451/107
6,916,229 B2 * 7/2005 Kao ..... B24B 41/002 451/28
2006/0223427 A1 * 10/2006 Tsumuraya ..... B24B 5/40 451/61
2007/0209400 A1 * 9/2007 Hofmann ..... C03B 37/0126 65/435
2010/0329801 A1 * 12/2010 Liang ..... B24B 5/185 408/1 R
2011/0053469 A1 * 3/2011 McDowell ..... B24B 5/40 451/61

* cited by examiner

METHOD FOR PRODUCING A QUARTZ-GLASS HOLLOW CYLINDER

The present invention refers to a method for producing a hollow cylinder made of quartz glass in that there is provided a start cylinder comprising a central axis, in which by means of a drill an end bore which coaxially extends relative to the central axis is produced or an existing inner hole is enlarged to obtain the end hole, whereby said drill which comprises a drill rod and a drill head non-rotationally fixed thereto rotates about a horizontal rotation axis, the drill head has a continuously changing drill head position which is continuously determined by means of a measuring device and said drill head is returned to a nominal position in case of a deviation.

Such hollow cylinders of quartz glass serve, as semi-finished products, the production of optical fibers or of preforms for optical fibers. They are for instance used as cladding tubes to overclad so-called "core rods" with additional cladding glass. Overcladding can be performed by collapsing and elongating a coaxial assembly of the hollow cylinder of quartz glass on the core rod inserted into the internal bore. Preforms are thereby produced and optical fibers are subsequently drawn from said preforms. It is also known that the hollow cylinder is collapsed during fiber drawing onto a core rod. Dimensionally stable hollow cylinders of quartz glass are also used in semiconductor production as reactor chambers or cladding tubes and as start materials for elongating quartz glass tubes.

The production of the quartz-glass hollow cylinder often includes a mechanical treatment for a quartz glass cylinder in which an internal bore is produced by deep-hole drilling or an existing internal bore is enlarged. Special attention is paid to the dimensional stability of the internal bore because this bore should be adapted to the external diameter of the core rod as exactly as possible to avoid uncontrollable plastic deformations during collapsing of the hollow cylinder in preform or fiber production. This requires additional safety measures for the hollow cylinder both with respect to the radial dimensions and with respect to the length, which leads to material losses and thus increased production costs. It is possible by way of deep-hole drilling and by using known honing and grinding methods to produce hollow cylinders of quartz glass with external diameters of more than 100 mm and a length of 2 m and more.

Deep-hole drilling is carried out in a vertical or horizontal arrangement of the drill rod. To avoid—in the course of horizontal deep-hole drilling—a drifting of the drilling tool caused by the dead weight of the drill head and the drill rod, the start cylinder to be drilled is rotated in counter direction with respect to the drill.

JP 2010-247340 A discloses a method of the aforementioned type. The internal bore of a solid cylinder of synthetic quartz glass is drilled out to a predetermined dimension by pressing in a core drill which comprises a horizontally oriented drill rod with a drill head mounted thereon. The drill head comprises a drill bit of magnetic material which is rotating about a rotation axis. The position of the drill bit inside the internal bore is continuously determined with the help of a measuring device. For this purpose the measuring device is displaceably supported on a slide outside the internal bore and is moved at the same feed rate as the drill. The drill position is measured optically, capacitively, via radio or by means of ultrasound. If a deviation of the drill from its nominal position is detected, it is again returned into the central axis of the internal bore. This is done by means of magnetic force under the action of a magnetic field generator which comprises four electromagnets that are evenly distributed around the central axis and are also mounted on the slide and permit the generation of a non-rotation symmetric magnetic field.

TECHNICAL OBJECTIVE

The measuring device permits the permanent detection of the current drill position and, if necessary, an automatic counteraction by generating or changing the non-rotation symmetric magnetic field and its action on the magnetic drill bit.

The known method permits the production of hollow cylinders which are distinguished by exact cylinder symmetry with annular cross-section and by minor dimensional deviation. The constructional efforts are however great; the need for a ferromagnetic drill bit restricts the selection of suitable materials and may lead to the introduction of particularly undesired impurities into the wall of the internal bore of the hollow cylinder.

It is therefore the object of the present invention to indicate an inexpensive method for producing a dimensionally stable hollow cylinder of quartz glass.

GENERAL DESCRIPTION OF THE INVENTION

This object, starting from the method of the aforementioned type, is achieved according to the invention in that the returning to the nominal position comprises a rotation of the start cylinder about the central axis in such a manner that the drill head position moves above the central axis.

The drill head has a great weight and the drill rod often has a considerable length of several meters. When the drill rod is horizontally arranged, the drill head tends to drift away downwards under the action of its weight. This can be counteracted by rotating the start cylinder in a direction opposite to the drill. In the case of start cylinders with ideal cylinder geometry, a rotating in the opposite direction is therefore a particularly simple measure to achieve a central internal bore and a uniform wall thickness of the hollow cylinder also without any considerable design and measurement work. The start cylinder, however, often exhibits a non-ideal geometry, such as e.g. a "banana shape". In these cases and even in the case of a rotating start cylinder one may obtain a radially irregular cylinder wall (also called "wall one-sidedness" hereinafter).

To remedy this situation, the position of the drill head is measured according to the invention consecutively, i.e. continuously or from time to time, and it is determined on the basis of this information whether the drill head continues to extend in its nominal position in the central axis or is offset thereto. In case of a deviation from the nominal position a possible rotation of the start cylinder is interrupted or stopped and the start cylinder to be drilled is rotated about its central axis such that the drill head position comes to lie above the central axis, ideally exactly vertically above the central axis. The drill head thereby occupies a fixed or variable intermediate position above the plane and, starting from this intermediate position, it will resume its nominal position. In the course of the further drilling process the drill head will move due to its weight downwards towards the central axis with the start cylinder being still in a resting state or at best moved a little. As soon as the central axis of the start cylinder extends in a direction coaxial to the rotation axis of the drill, the nominal position of the drill head will be reached.

Hence, in the method according to the invention the principle of gravity is exploited for returning the drill to its nominal position. A complicated device for the forced repositioning of the drill head, such as e.g. the magnetic field generator known from the prior art, is thus not needed. Moreover, the invention does also not make any special demands on the configuration of the drill head with respect to the material; to be more specific, the drill head or essential parts thereof need not necessarily consist of a magnetic material.

An optimal exploitation of the force of gravity for position correction requires an arrangement of the start cylinder with horizontally extending central axis. It is evident that minor deviations from the horizontal arrangement represent a slightly inferior embodiment of the invention.

The start cylinder is rotated or twisted for repositioning the drill head deviating from its nominal position to an intermediate position above the central axis. In the simplest case a small angle of rotation of 180° or less is sufficient for this. Thereafter, it is possible to stop the rotation of the start cylinder, so that the drill head remains in the radial intermediate position that has been occupied. As the drill head remains vertically above the central axis, this brings about the fastest possible change in the drill head position towards its nominal position.

The start cylinder, however, can also be reciprocated to swing about this intermediate position in pendulum fashion, or it may even be rotated about its central axis at a variable speed on condition that the residence time of the drill head in the area above the central axis is longer than below the axis. These methods lead to a slower adaptation of the drill head position towards its nominal position. A certain lasting movement of the start cylinder is advantageous to avoid sudden changes in the drill head position, which may lead to a tearing away.

The drill head position is corrected permanently or whenever the deviation between nominal position and actual position of the drill head exceeds a predetermined limit value.

In the last-mentioned case the operational phase is interrupted by one or more correction phases. During the operational phase in which the drill head is in its nominal position, the start cylinder can rotate opposite to the drill, whereas during the correction phase it is resting, apart from the above-described rotating or twisting or a possible post-correction, or it is rotated in pendulum fashion or at a variable circumferential speed, as has been explained above.

In a first preferred procedure, it is therefore provided that the generation of the end bore comprises operational phases and at least one correction phase in which the drill head is returned to its nominal position, and that the start cylinder is rotated during the operational phases opposite to the drill about the central axis.

Apart from the correction phase during which the drill head is returned by gravity to its nominal position, the start cylinder is here rotating opposite to the drill. This reduces the risk that the drill head might travel away from the central axis.

In the method of the invention, however, a rotation of the start cylinder can also be completely omitted if the position is permanently corrected. Therefore, in an alternative and equally preferred procedure it is provided that the generation of the end bore comprises an operational phase and at least one correction phase in which the drill head is returned to its nominal position, with the start cylinder being fixed during the operational phases.

In the drilling process the start cylinder is here not rotated about its central axis and the drilling process includes corrections of the drill head position that are performed in parallel and continuously, as far as necessary.

Upon use of a start cylinder which is configured as a hollow cylinder right from the beginning, the drilling process serves not only to enlarge the bore, but also to improve the dimensional stability, particularly to reduce a possible wall one-sidedness in the start cylinder. In this context it has turned out to be useful when before the beginning of the drilling process the radial wall thickness profile over the hollow-cylinder length is determined, and that the wall thickness profile determined in this way is taken into account during returning of the drill head position.

The measuring device for the continuous determination of the position of the drill head can also be used for determining the axial and radial wall thickness profile in advance. The consideration of the wall thickness profile which has been determined individually in advance for the start cylinder facilitates the elimination or reduction of wall one-sidedness.

Alternatively or in addition, the extension of the central axis over the start-cylinder length is determined before the beginning of the drilling process; the axial extension of the central axis which has been determined in this way is here taken into account during returning of the drill head position.

As has already been explained further above, the start cylinder may have a curved central axis and particularly a so-called "banana shape". In such cases it may be advantageous when the nominal rotation axis of the drill extends outside the (curved) central axis of the start cylinder.

Therefore, in the case of an uneven extension of the central axis over the start cylinder length a best-fit straight line is determined and a nominal rotation axis for the rotation of the drill is defined to be coaxial to the best-fit straight line.

When a start cylinder is used that is configured as a hollow cylinder, the drill can be pressed through the existing internal bore, also called "percussion drilling". However, it has turned out to be particularly useful when the drill head in the case of a start cylinder which is configured as a hollow cylinder is drawn by means of the drill rod through the internal bore of the hollow cylinder.

The drill head position can be determined by means of laser and/or ultrasound measurement or by X-ray measurements. With ultrasound the wall thickness of the drilled start cylinder is preferably determined, whereas laser measurement preferably serves the optical detection of distances.

However, it has turned out to be particularly useful when the drill head position is optically detected by means of at least one camera and evaluated by means of image processing.

The image produced by means of a camera makes it possible to detect the drill head position at several measurement levels at the same time, e.g. in front of the drill head, in the center of the drill head and at the drill head tip. One camera is sufficient for the detection when the start cylinder is rotated. When two cameras are used having viewing directions perpendicular to each other, it is possible to fully detect the drill head position also in the case of a non-rotating start cylinder.

Preferably, the determination of the drill head position comprises a rotating of the start cylinder about its central axis, with the drill head position being determined from time to time, but at the latest after each advance movement of the drill head by 5 cm.

The quartz-glass hollow cylinder produced in this way is preferably used for producing a preform for an optical fiber in that it is collapsed onto a core rod and simultaneously elongated so as to form the preform.

Equally preferred is an application of the quartz-glass hollow cylinder according to the invention for producing an optical fiber in a drawing method in which the hollow cylinder is collapsed onto a core rod and simultaneously drawn so as to form the fiber.

The hollow cylinder is also suited for use as a particularly dimensionally stable component in semiconductor manufacture or as a start material for the elongation of tubes.

EMBODIMENT

Figure 2:
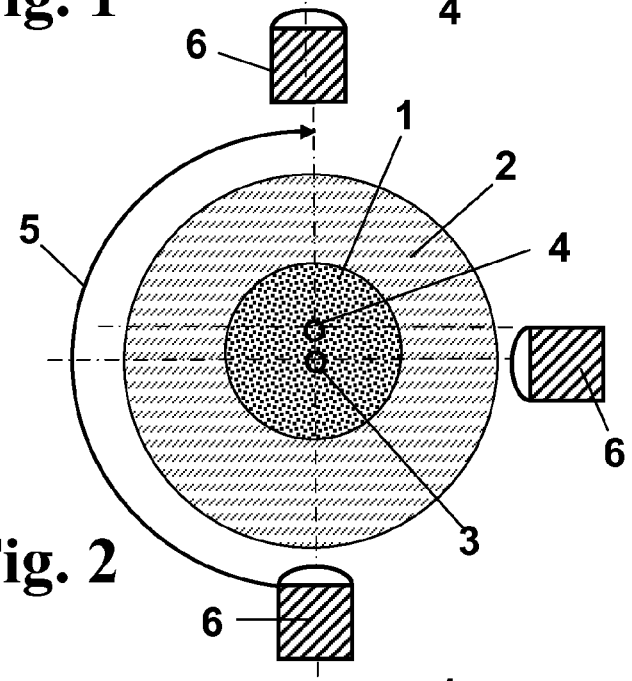
Figure 3:
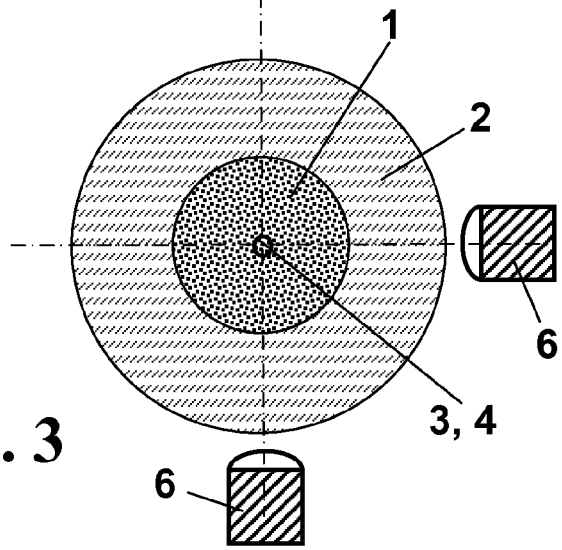

The invention shall now be explained in more detail with reference to an embodiment and a drawing. In a schematic diagram, FIG. 1 shows a top view on the face side of a start cylinder with a deviation of the drill position;

FIG. 2 shows a top view on the face side of the start cylinder after rotation of the start cylinder for starting the correction of the drill position; and FIG. 3 shows a top view on the face side of the start cylinder after correction of the drill position.

First of all, a quartz glass blank is produced according to the OVC method. To this end soot particles are deposited layer by layer on an aluminum oxide tube which is rotating about its longitudinal axis and has an outer diameter of 39 mm, by reciprocating a row of deposition burners, wherein $SiCl_4$ is supplied to the deposition burners and oxidized in a burner flame in the presence of oxygen into $SiO_2$ and hydrolyzed.

After completion of the deposition method and removal of the aluminum oxide tube a soot tube is obtained that is subjected to a dehydration treatment and introduced in vertical orientation into a dehydration furnace and treated at a temperature ranging from 850° C. to about 1000° C. in a chlorine-containing atmosphere. The treatment duration is about six hours.

The soot tube treated in this way is subsequently vitrified in a vitrification furnace at a temperature in the range of about 1400° C., with the soot tube being collapsed onto a graphite rod having an outer diameter of 38 mm. The tubular quartz-glass blank of synthetic quartz glass obtained in this way has a weight of about 205 kg, its outer diameter is 203 mm, the inner diameter is 38 mm and its length is about 3000 mm.

The outer wall of the quartz glass blank is subjected to cylindrical grinding, and possibly existing bubbles and defects in the surfaces are eliminated. To determine a potential wall one-sidedness, the wall thickness is measured in radial and axial direction. To this end the quartz glass blank is introduced into a deep-hole drilling device in a horizontal orientation of its central axis. The drilling device is equipped with a camera measurement system which is movable on a slide along the central axis of the blank. For the measurement of the wall thickness profile the blank is rotated about its central axis and the camera is simultaneously moved along the central axis. The images produced by the camera are supplied to an image evaluation unit so as to determine wall one-sidedness. The wall thickness profile determined thereby is used in the subsequent drilling process.

In another quartz glass blank, the outer wall was not ground. To determine a possible "banana shape", the extension of the central axis of the bore over the length of the blank was measured. The central axis is obtained by juxtaposition of the center points of each axial measurement position.

The quartz glass blank was introduced for this purpose with a horizontally oriented central axis into the deep-hole drilling device and measured by means of the camera measuring system which is moved on the slide along the central axis of the blank. Two cameras may be provided having viewing directions perpendicular to each other. The surfaces of the blank are covered in advance with an immersion oil so as to make them transparent for the camera measurement.

The images produced by the cameras are supplied to an image evaluation unit to determine the curvature of the central axis. If the curvature exceeds a predetermined limit value, a best-fit straight line is laid through the central axis which is used as a nominal rotation axis for the drill rotation in the subsequent drilling process.

In the drilling process the wall of the internal bore is treated by using a drill having a shaft with a drill head fixed thereto, whose drill bit is covered with diamond grains and the maximal external diameter of which is 42 mm.

The drill is pulled, starting from one end, by means of the shaft through the existing bore, the drill rotating about its rotation axis at about 480 rpm. The quartz-glass hollow cylinder to be drilled is here in a rest state. The removal depth of the inner wall which has been produced by drilling is about 2 mm.

With the help of the camera measurement system previously used for measuring the wall one-sidedness and the central-axis curvature, the radial position of the drill head is determined continuously and passed on for evaluation to a computer into which the information on the wall thickness profile and the central-axis curvature of the currently drilled quartz-glass hollow cylinder is fed, and on the basis of which the nominal position of the drill head is determined over the whole length of the hollow cylinder.

The nominal position of the drill head—and thus the rotation axis of the drill—is normally located in the central axis of the hollow cylinder to be drilled. In the case of wall one-sidedness the nominal position can be shifted arithmetically also offset to the central axis so as to eliminate or reduce one-sidedness.

In FIGS. 1 to 3, the drill head is designated by reference numeral 1, the hollow cylinder to be drilled by reference numeral 2, the central axis of the hollow cylinder 2 by reference numeral 3, the rotation axis of the drill head 1 by reference numeral 4, and the two cameras of a detection and evaluation system by reference numeral 6.

FIG. 1 schematically shows the situation where a central-axis offset has been detected for the drill head 1, the offset being so large that a previously set limit value of 0.25 mm is exceeded. In the embodiment this is the case as soon as the rotation axis 4 of the drill head 1 is about 0.25 mm below the central axis 3 of the hollow cylinder. To achieve this accuracy, the optical resolution of the two cameras 6 is 0.1 mm.

The resting hollow cylinder 2 of quartz glass together with the drill head 1 rotating therein is thereupon rotated in a computer-controlled manner about its central axis 3, as shown by the directional arrow 5 in FIG. 2. In the embodiment the rotation angle is exactly 180°, so that the rotation axis 4 of the drill head 1 now lies approximately 0.25 mm vertically above the central axis 3.

In the course of the further drilling process the drill head 1 is moving downwards towards the central axis 3 due to its weight while the hollow cylinder 2 is still resting. As soon as the central axis 3 of the hollow cylinder extends coaxial to the rotation axis 4 of the drill head 1, the drill head position is regulated. In this situation, which is shown in FIG. 3, either the hollow cylinder 2 of quartz glass is rotated in the opposite direction with respect to the drill head 1 so as to stabilize the current ideal drill-head position, or the hollow cylinder 2 of quartz glass is still resting until a renewed position correction requires a rotating or twisting about its central axis 3.

The internal bore is finished by way of honing using a honing machine in a multistage treatment process in which the degree of polish is continuously refined. The final treatment is carried out with a D7 honing stone (FEPA standard). The quartz-glass hollow cylinder obtained thereafter is subsequently etched for a few minutes in a hydrofluoric-acid etching solution in which an etch rate of about 1 μm/min is obtained at room temperature.

A quartz-glass hollow cylinder is thereby obtained with an internal diameter of about 43 mm, which is distinguished by an exact, dimensionally stable geometry.

The invention claimed is:

1. A method for producing a hollow cylinder made of quartz glass, said method comprising:

providing a start cylinder having a central axis, and a drill comprising a drill rod and a drill head non-rotationally fixed thereto, and producing with the drill an end bore that extends coaxially relative to the central axis, or enlarging an existing internal bore to obtain the end bore, wherein said drill rotates about a horizontal rotation axis, and the drill head has a continuously changing drill head position that is continuously determined using measuring device and said drill head is returned to a nominal position in case of a deviation, and wherein the drill head is returned to the nominal position by a rotating of the start cylinder about the central axis such that the drill head position moves above the central axis.

2. The method according to claim 1, wherein during the rotating of the start cylinder the drill head moves vertically above the nominal position.

3. The method according to claim 1, wherein the producing of the end bore comprises a plurality of operational phases and at least one correction phase in which the drill head is returned to the nominal position thereof, and wherein the start cylinder is rotated during the operational phases opposite to the drill about the central axis.

4. The method according to claim 1, wherein the producing of the end bore comprises a plurality of operational phases and at least one correction phase in which the drill head is returned to its nominal position, and wherein the start cylinder is fixed during the operational phases.

5. The method according to claim 1, wherein the start cylinder is a hollow cylinder and, before the producing of the end bore, a radial wall thickness profile over a total length of the hollow cylinder is determined, and the wall thickness profile determined in this way is used when the drill head is returned.

6. The method according to claim 1, wherein the central axis extends along a path over a length of the start cylinder, and the path is determined before beginning the producing of the end bore and wherein the path of the central axis is taken into account when the drill head is returned.

7. The method according to claim 6, wherein, when the path of the central axis over the start cylinder length is irregular, a best-fit straight line is determined, and a nominal rotation axis for the drill rotation is defined to be coaxial to the best-fit straight line.

8. The method according to claim 1, wherein the start cylinder is a hollow cylinder member, and the drill head is drawn by means of the drill rod through the internal bore of the hollow cylinder member.

9. The method according to claim 1, wherein the drill head position is optically detected by an at least one camera and evaluated by image processing.

10. The method according to claim 1, wherein the drill head position is determined by a process that comprises a rotating of the start cylinder about the central axis thereof, and the drill head position is determined, at least each time the drill head moves forward by 5 cm.

* * * * *